US005685348A

United States Patent [19]

Wegman et al.

[11] Patent Number: 5,685,348

[45] Date of Patent: Nov. 11, 1997

[54] ELECTROMAGNETIC FILLER FOR DEVELOPER MATERIAL

[75] Inventors: Paul M. Wegman, Pittsford; Mikhail Vaynshteyn, Rochester, both of N.Y.; Oleg Y. Abramov, St. Petersburg, Russian Federation; Sergei D. Raybov, St. Petersburg, Russian Federation; Yuri A. Yudin, St. Petersburg, Russian Federation; Alexander G. Kashkarov, St. Petersburg, Russian Federation; Alexander N. Gerasimov, St. Petersburg, Russian Federation

[73] Assignee: Xerox Corporation, Stamford, Conn.

[21] Appl. No.: 690,412

[22] Filed: Jul. 25, 1996

[51] Int. Cl.[6] ..... B65B 1/04

[52] U.S. Cl. ..... 141/2; 141/18; 141/129; 53/503; 137/909

[58] Field of Search ..... 141/1, 2, 18, 129, 141/172, 192, 275, DIG. 1; 222/424.5; 53/503; 137/909

[56] References Cited

U.S. PATENT DOCUMENTS

| | | | |
|---|---|---|---|
| 4,463,502 | 8/1984 | Fitzgerald | 137/909 |
| 4,655,237 | 4/1987 | Gloor et al. | 137/13 |
| 4,932,355 | 6/1990 | Neufield | 118/652 |
| 4,987,951 | 1/1991 | Dietrich et al. | 164/466 |
| 5,095,338 | 3/1992 | Hayes, Jr. et al. | 355/246 |
| 5,337,794 | 8/1994 | Nishiyama et al. | 141/144 |
| 5,438,396 | 8/1995 | Mawdesley | 355/260 |

*Primary Examiner*—Henry J. Recla
*Assistant Examiner*—Steven O. Douglas

[57] ABSTRACT

A method and apparatus for filling a container with toner using a series of traveling magnetic fields to control the flow of toner from a supply of toner to the container. Initially, an empty container is placed under a fill tube through which the toner will be supplied to the container. In the filling process the traveling magnetic fields, which are supplied by turning on and off a series of solenoids, and gravity cause toner from the toner supply to move through the fill tube. When a solenoid is turned on toner particles are attracted to its magnetic field where a plug of toner is formed. The solenoids are controlled so that a discrete amount of toner is supplied in each on/off cycle of the solenoids. The solenoid on/off cycle is repeated until the container is filled with toner. When the container is filled, the appropriate solenoid is activated so that a plug of toner stops the flow of toner in the fill tube. The filled container is removed from the fill tube and an empty container is put in its place so that the solenoid on/off cycle may begin again.

20 Claims, 14 Drawing Sheets

ELECTROMAGNETIC FILLER FOR DEVELOPER MATERIAL

BACKGROUND

This invention relates generally to filling a container with developing material, and more particularly concerns an electromagnetic toner filler using a traveling magnetic field which moves toner from a toner supply hopper through a fill tube to a toner container.

Currently when filling toner containers, toner is transported from the toner supply hopper into the container by a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner friction. High auger speed will cause the toner to melt.

In toner container filling operations which use mechanical opening and closing devices to control the flow of the toner, toner is deposited on the exterior of the container when separating the cartridge from the filler after the end of the filling process. This happens because during filling the friction between the toner and the metal surfaces of the filler generates an electrostatic field. The forces of this field attract and retain toner particles on the inner and outer surfaces of the mechanical closing device. At the end of the filling cycle when the toner movement is stopped, the electrostatic field begins to dissipate. During the process of separation of the container from the filler, some of the toner particles fall off from the surfaces to which they were attracted, thereby contaminating the outer surface of the containers. This creates an additional cost, since the outer surface of the containers must be cleaned after filling. The escaping toner also contaminates the surrounding environment. Yet another problem of current mechanical opening and closing devices is that the tooling consists of several moving parts which consume valuable time when opening and closing which results in a prolonged filling cycle. Mechanical systems also have the problem of toner buildup, the formation of large particles, which can contaminate the toner The problems associated with controlling the filling of toner containers are due to the properties of the toner. Toner is the image-forming material in a developer which when deposited by the field of an electrostatic charge becomes the visible record. There are two different types of developing systems known as one-component and two-component systems. In one-component developing systems, the developer material is toner made of particles of magnetic material, usually iron, embedded in a black plastic resin. The iron enables the toner to be magnetically charged. In two-component systems, the developer material is comprised of toner which consists of small polymer or resin particles and a color agent, and carrier which consists of roughly spherical particles or beads usually made of steel. An electrostatic charge between the toner and the carrier bead causes the toner to cling to the carrier in the development process. Control of the flow of these small, abrasive and easily charged particles is very difficult.

The following disclosures may be relevant to various aspects of the present invention:

U.S. Pat. No. 5,337,794

Inventor: Nishiyama et al.

Issued Aug. 16, 1994

U.S. Pat. No. 5,438,396

Inventor: Mawdesley

Issued Aug. 1, 1995

US Pat. No. 5,095,338

Inventor: Hayes, Jr. et al.

Issued: Mar. 10, 1992

U.S. Pat No. 4,932,355

Inventor: Neufeld

Issued: Jun. 12, 1990

The relevant portions of the foregoing disclosures may be briefly summarized as follows:

U.S. 5,337,794 describes a powder filling apparatus and a method for filling a container with powder. The toner container is filled by conveying toner from a supply hopper through a nozzle with a valve on the end. The valve is disposed at the bottom opening of the nozzle to release and close the opening of the nozzle by the vertical movement of the valve element.

U.S. 5,438,396 is drawn to a toner anti-dribble device which is attached to a toner container having a vertical fill tube and a rotatable auger for feeding toner into a toner container. The toner anti-dribble device also has a sleeve member engagable with the fill tube. A plurality of flexible insertion wires are inserted through the sleeve member into the toner container and disposed substantially perpendicular to the insertion direction of the toner. The arrangement of the wires positively prevents toner dribble between fills while being flexible enough to flex in proportion to the fill rate, which prevents fusing of the toner on the wires.

U.S. Pat. No. 5,095,338 teaches a developer which discharges used carrier particles using a magnetic valve. Discharge of developer material from the developer housing is controlled by a permanent magnet and an electromagnet positioned adjacent an exit port in the developer housing. The permanent magnet generates a magnetic flux field in the region of the exit port to form a developer material curtain which prevents the passage of developer material from the exit port. When the electromagnet is energized, it generates a magnetic flux field which attracts developer material from the developer material curtain. Upon de-energization of the electromagnet, the developer material attracted to it is discharged.

U.S. 4,932,355 discloses a method for removing a developer mix from a developing station with a magnetic closing device which is in the vicinity of a discharge opening in the developing station. In its energized condition, the magnetic closing device creates a magnetic field which acts on the developer mix to form a plug of developer mix in the region of the discharge opening. In the de-energized condition, the magnetic closing device releases the plug of developer mix.

U.S. patent application Ser. No. 08/540,993 filed Oct. 12, 1995 entitled "Electromagnetic Valve and Demagnetizing Circuit", Wegman et al., which is assigned to the same assignee as this application, teaches a method and apparatus for filling a container with a magnetic material using an electromagnetic valve and a demagnetizing circuit to control the flow and properties of the material. In the filling process an auger located inside of the fill tube rotates and moves the material through the fill tube. When the container is filled, the auger stops rotating and the electromagnetic valve is actuated. The electromagnetic valve supplies a magnetic field which holds the material in place, plugging the fill tube with the material as the container is removed and a new container is placed to be filled. When the electromagnetic valve is switched off, a demagnetizing circuit is activated. After the material is demagnetized the auger is switched on and the material flows again to fill the container.

All of the above references are hereby incorporated by reference.

SUMMARY

In accordance with one aspect of the present invention, there is provided a method and apparatus for filling a container with toner having an empty container placed in filling relationship to a fill tube and a supply of toner and a traveling magnetic field applied to the fill tube so that toner moves from the toner supply through the fill tube and into the container. The container is removed when it is full of toner and another container is placed under the fill tube to be filled.

Pursuant to another aspect of the present invention, there is provided an apparatus for controlling filling of a container having a hopper with a supply of toner and a fill tube through which toner from the hopper passes to a container to be filled with toner. Solenoids are located along the fill tube and are controlled to create a traveling magnetic field within the fill tube so that toner in the hopper and in the fill tube is attracted to the magnetic field, causing the toner to move from the hopper through the fill tube. A demagnetizing circuit demagnetizes the toner prior to the toner leaving the fill tube. A conveyor moves an empty container into filling relationship with the fill tube and removes the container once it is filled with toner and moves another empty container into the filling position.

The present invention is drawn to an electromagnetic filler which moves toner from a toner supply hopper through a fill tube to a container. A series of magnetic fields are generated which attract and move the toner through the fill tube instead of using a mechanical toner mover such as an auger to move the toner. The traveling magnetic field system allows the toner to be moved much faster and without the heating problems due to friction than a mechanical toner mover system.

DRAWINGS

Other features of the present invention will become apparent as the following description proceeds and upon reference to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
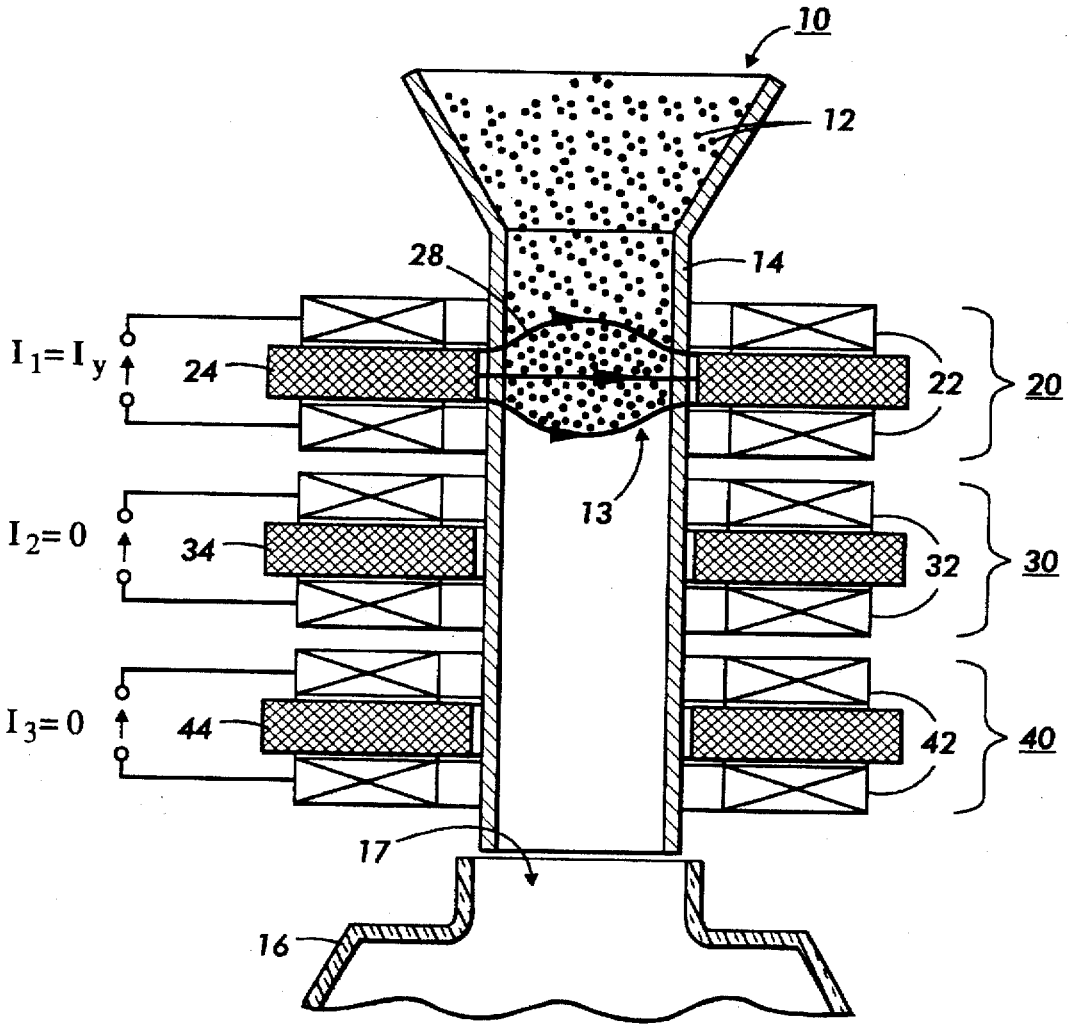
FIGS. 1–4 are cross-sectional schematic views of an open channel radial magnetic field toner filling device at times $t_1$–$t_4$.

The first embodiment of the electromagnetic toner filler to be discussed is shown in FIG. 1. A hopper 10 with a supply of toner 12 is connected to a fill tube 14 which directs toner 12 into a toner container 16. The fill tube is sized so that it is slightly smaller than the toner container opening 17. The electromagnetic toner filler system has three sections each of which contains a solenoid with ferromagnetic ring-shaped magnetic circuit with a winding on each ring. Solenoids 20, 30 and 40 are comprised of windings 22, 32 and 42 wrapped around a ferromagnetic rings 24, 34 and 44 located on the fill tube through which the toner 12 passes. For ease of viewing, the three solenoid sections are shown as equally oriented with respect to the central channel, however for optimum mutual magnetic conduction and axial size of the filler, the angle between the magnetic circuits should be maximized and in the case of the three ring embodiment the angle is 120 degrees.

An activated solenoid will generate a radial magnetic field sufficient to freeze or stop all toner particles inside the fill tube, the respective currents being shown as I1, I2 and I3 for solenoids 20, 30 and 40. While current flows through the solenoid, a magnetic toner plug 13 is formed at the gap of the ferromagnetic ring in the fill tube. The toner plug 13 travels from the top to the bottom of the fill tube together with toner located above it, the toner particles traveling under the influence of both gravitation and magnetic forces. As the plug travels through the fill tube, toner is being supplied from the hopper to the fill tube at a rapid rate. In order to prevent excessive clogging of the toner, the toner should be agitated in the hopper to ensure proper toner flow. An electronic control device ensures the appropriate switching of the current in the solenoids, which controls the magnetic field travel. FIGS. 1 through 4 depict the operation of the electromagnetic filler at four different time intervals.

FIG. 1 shows the electromagnetic filler at time $t=t_1$, with a controlling current Iy produced in windings 22, activating solenoid 20. Solenoids 30 and 40 are turned off and the current in the three solenoids are I1=Iy, I2=0 and I3=0. Toner plug 13 is held in place by magnetic field 28 which is produced by solenoid 20.

Figure 2:
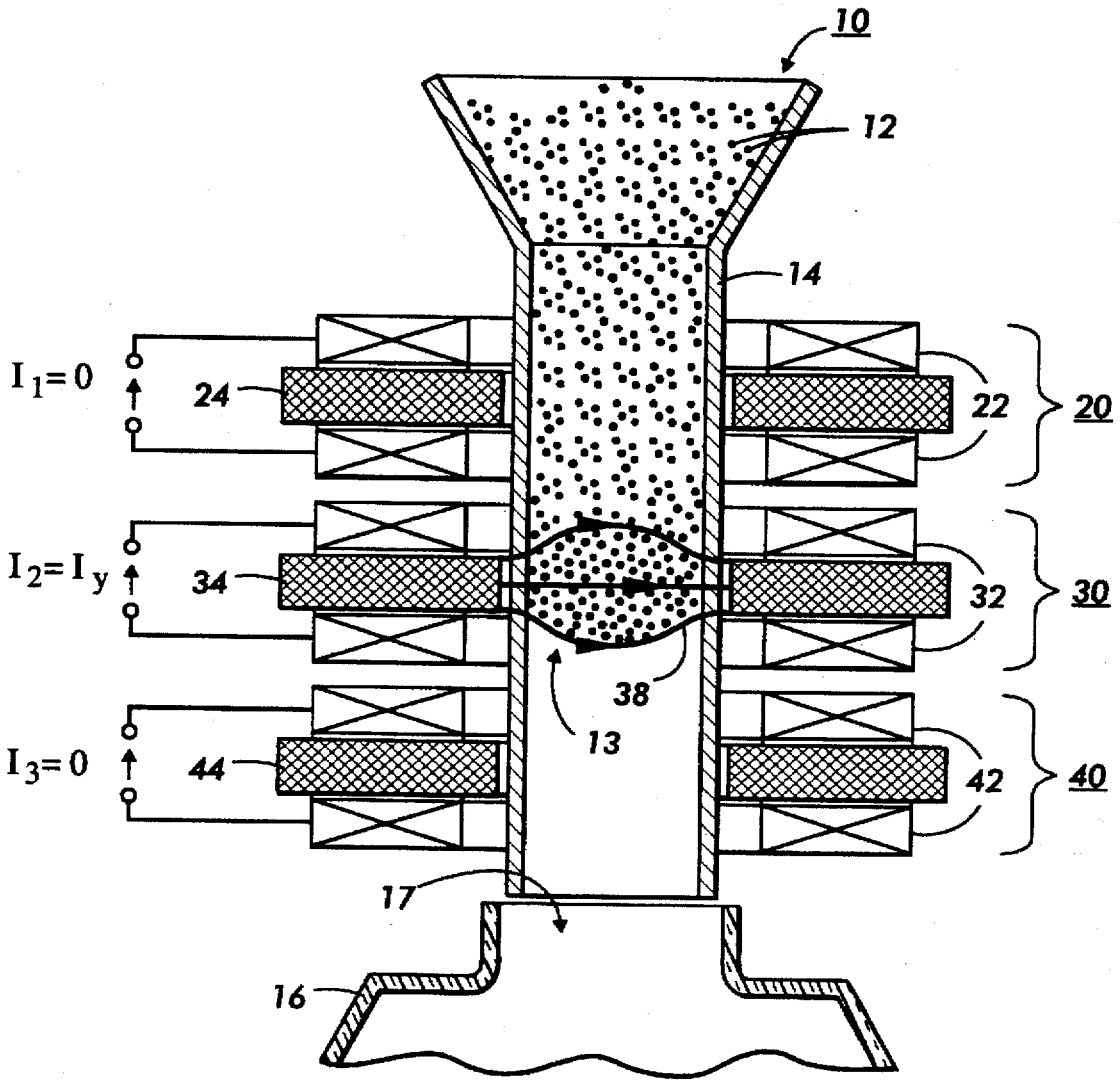

FIG. 2 shows the electromagnetic filler at time $t=t_2$. At this time solenoid 30 is turned on and solenoids 20 and 40 are turned off, I1=0, I2=Iy and I3=0. At this time, the toner plug 13 has moved down the fill tube and is stopped by the magnetic field 38 created by solenoid 30. Toner from the toner supply hopper 10 has moved from the hopper into the fill tube 14 to fill the space on top of the plug 13.

Figure 3:
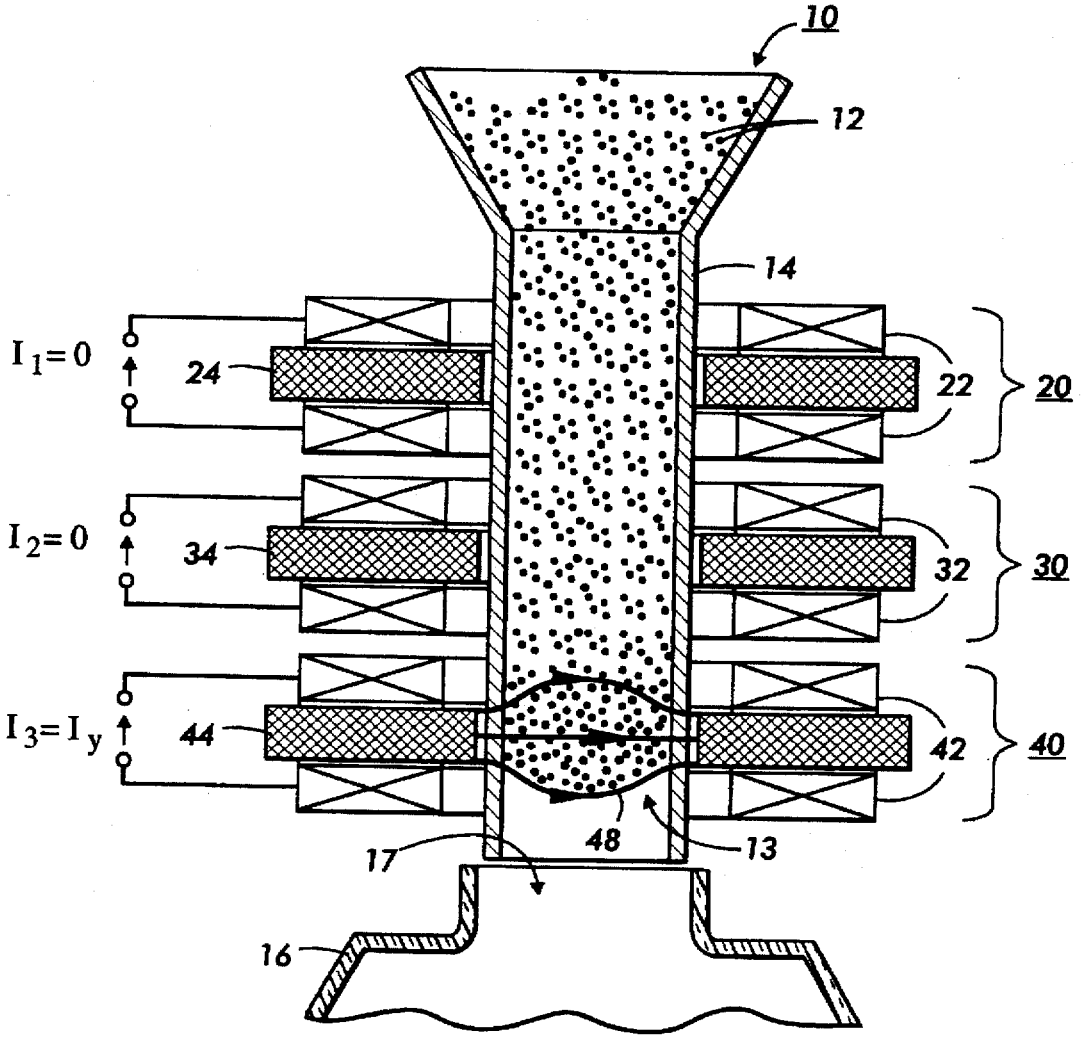

FIG. 3 shows the electromagnetic filler at time $t=t_3$. Solenoid 40 is turned on and solenoids 20 and 30 are turned off with I1=0, I2=0 and I3=Iy. Again, toner from the supply hopper 10 has entered the fill tube from the movement of the toner plug 13 to magnetic field 48 created by solenoid 40.

Figure 4:
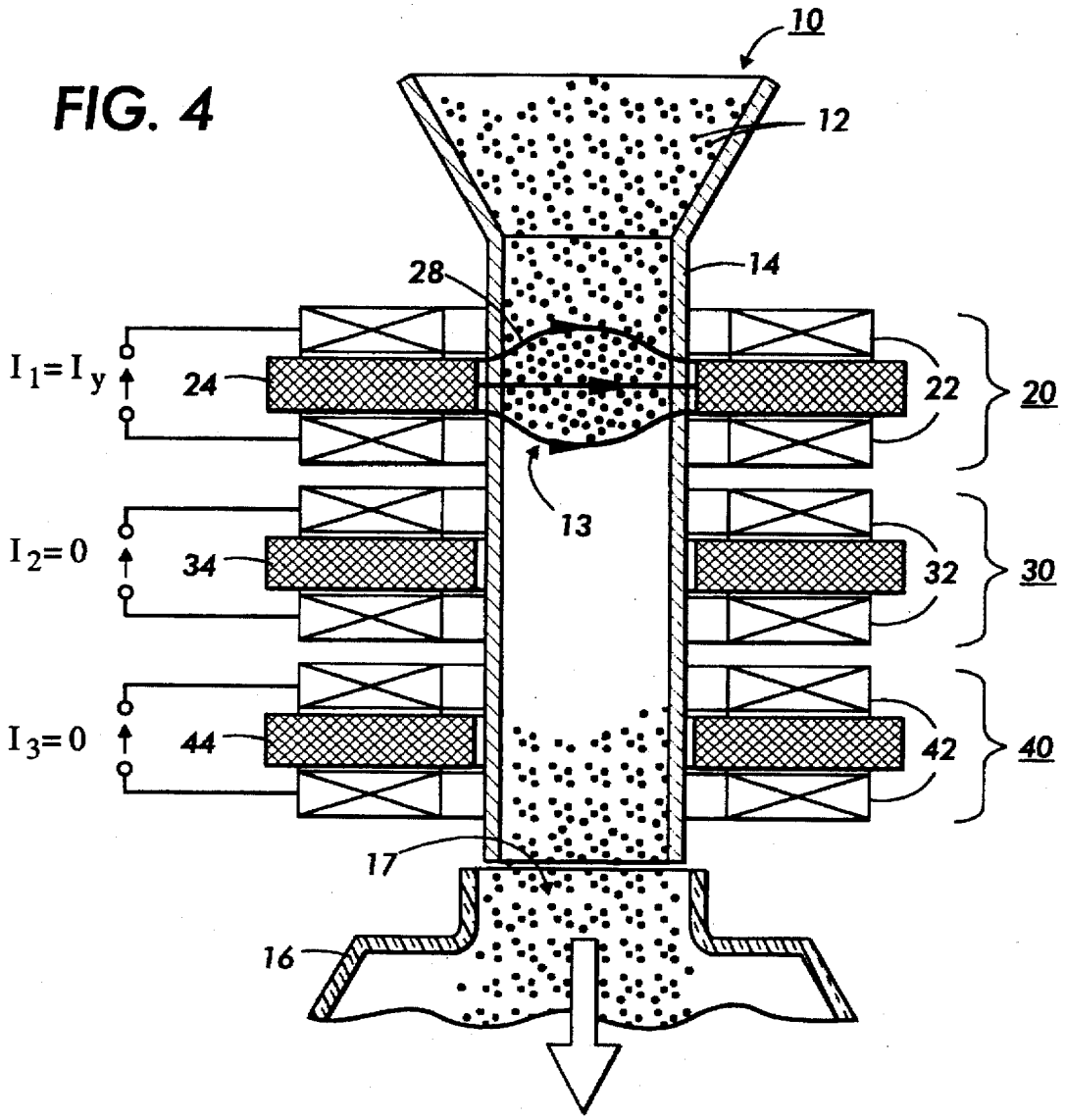

FIG. 4 shows the electromagnetic filler at time $t=t_4$. Solenoid 20 is activated again and solenoids 30 and 40 are turned off, I1=Iy, I2=0 and I3=0 at steady state. The toner in the fill tube below magnetic field 28 leaves the fill tube 14 to fill the toner container 16. The toner plug 13 is held by magnetic field 28 at times $t=t_1$ and $t=t_4$ and in the filling cycle the plug travels from magnetic field 28, to magnetic field 38 and then magnetic field 48. The cycle is repeated until the container is filled with toner. When the container is filled with toner, toner plug 13 held by one of the magnetic fields, for example magnetic field 28, which stops the flow of toner from the hopper 10. The filled toner container is cleanly removed and an empty toner container is put in its place. The toner filling operation is then repeated.

Before solenoid 40 is turned off so that the toner is allowed to flow into the empty container, an additional operation must be performed. Due to magnetic hysteresis effect, the particles which were held by the activated solenoid will retain some magnetic properties which will cause the toner to stick together, which inhibits the flow of toner. To overcome this problem of magnetized toner, the system requires a device to demagnetize the plug of toner.

Figure 5:
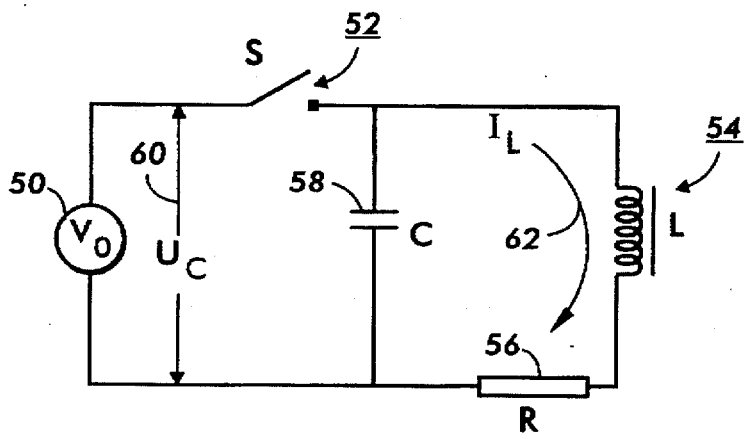
FIG. 5 is a schematic of a demagnetizing circuit.

FIG. 5 depicts a toner demagnetizing circuit which provides a rapid oscillative damped magnetic field. The circuit is integrated into the winding of solenoid 40. When solenoid 40 is switched off, opening switch S 52 the constant voltage source $V_0$ 50 which powers the solenoid is disconnected and the damped oscillation magnetic field is generated by the transient process at the winding of the solenoid, L 54 being the inductance of the solenoid 40 and R 56 being the resistance of the solenoid 40 or an external resistor, depending upon the desired operating conditions of the circuit. At this moment an electric capacitor C 58 which is parallel to the solenoid winding 54, is brought into the circuit and provides a decaying oscillating voltage source $U_C$ 60 causing $I_L$ current 62 through the coil which generates the oscillating magnetic field at the windings of the solenoid. This oscillating magnetic field demagnetizes the toner previously held by the magnetic field, leaving no measurable residual magnetization.

Figure 6:
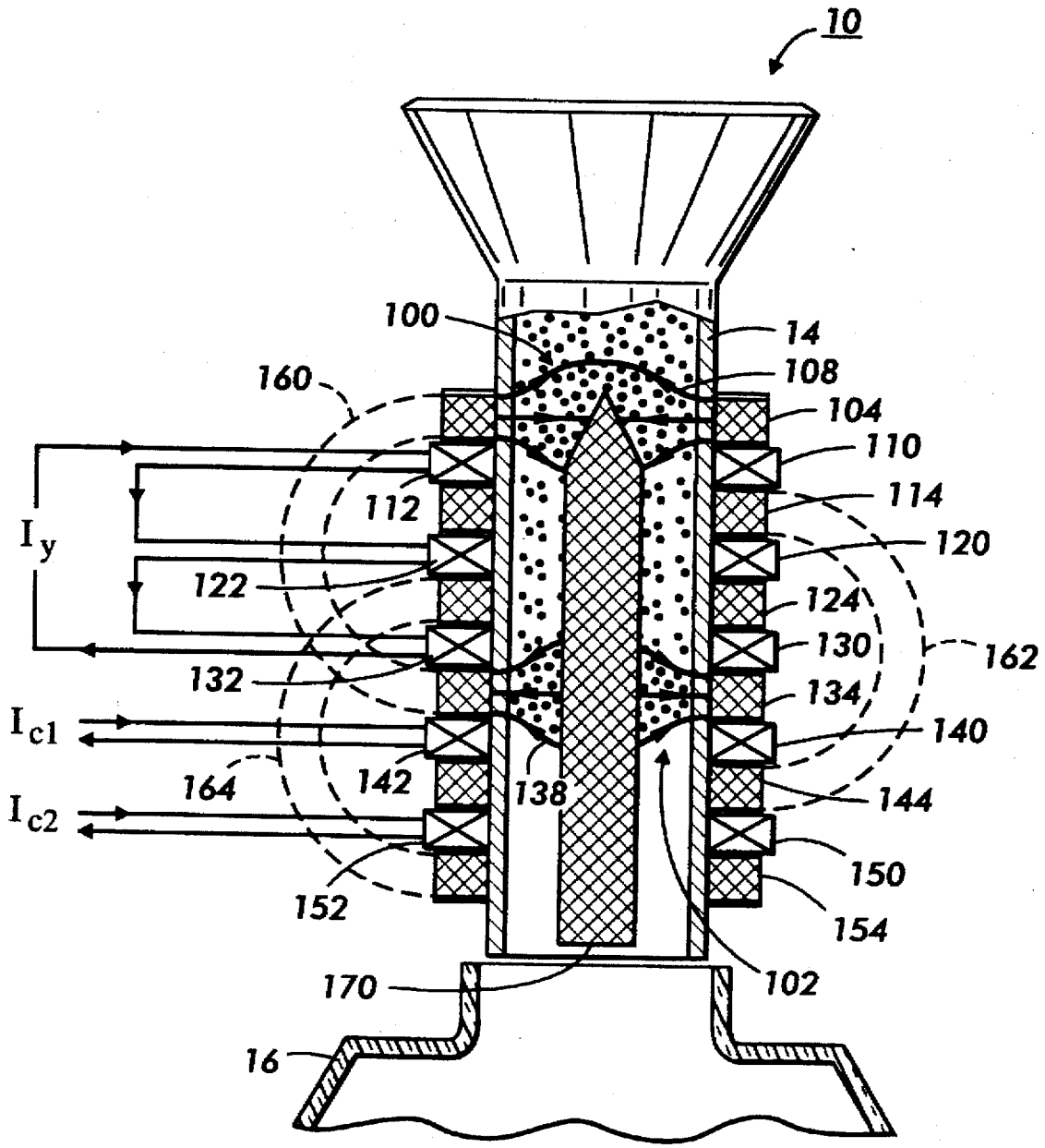
FIGS. 6–9 are cross-sectional schematic views of a radial magnetic field toner filling device with a magnetic core at times $t_1$–$t_4$.

FIG. 6 is another embodiment of the radial electromagnetic toner filler. In this embodiment there are five solenoid sections 110, 120, 130, 140 and 150 with windings 112, 122, 132, 142 and 152 divided by ferrite rings 104, 114, 124, 134, 144 and 154. The ferrite rings are in pairs respectively connected by external magnet conductors 160, 162 and 164. The external magnet conductors are ferrite plates; external magnet conductor 160 connecting ferrite rings 104 and 134, external magnet conductor 162 connecting ferrite rings 114 and 144, and external conductor 164 connecting ferrite rings 124 and 154. Again, the solenoids are shown as being equally oriented with respect to the fill tube, however the external magnetic conductors are set at an angle of 60 degrees in relation to one another for uniform mutual magnetic conductivity.

In this embodiment, a magnetic core 170 is in the inner channel of the fill tube 14. The core may be a ferrite core or any other suitable magnetic material core. Due to the core's magnetic properties, the magnetic field in the inner channel is directed perpendicularly to the motion of the flow of toner, creating radial magnetic fields. While the electromagnetic filler is operating, two magnetic plugs 100 and 102 are formed in the fill tube between the gaps in the ferrite rings and the magnetic core 170. The plugs travel through the fill tube with the toner above it as described above with respect to the open channel system.

The process of creating the traveling magnetic field is demonstrated in FIGS. 6–9 with the direction of currents in the solenoid coils schematically shown at four different time segments. FIG. 6 shows the electromagnetic filler at time $t=t_1$, with a controlling current Iy produced in windings connected in series 112, 122 and 132. The windings of the other two solenoids 140 and 150, respectively have currents Ic1 and Ic2 passed at this time. Currents Ic1 and Ic2 compensate for the magnetic fields created by current Iy in the non-functioning gaps of the magnetic circuit of the filler. The value of currents Ic1 and Ic2 are determined experimentally by the various phases of the work cycle of the filler. At this time toner plugs 100 and 102 are formed by magnetic fields 108 and 138 at ferrite rings 104 and 134 which are connected by the ferrite plate 160.

Figure 7:
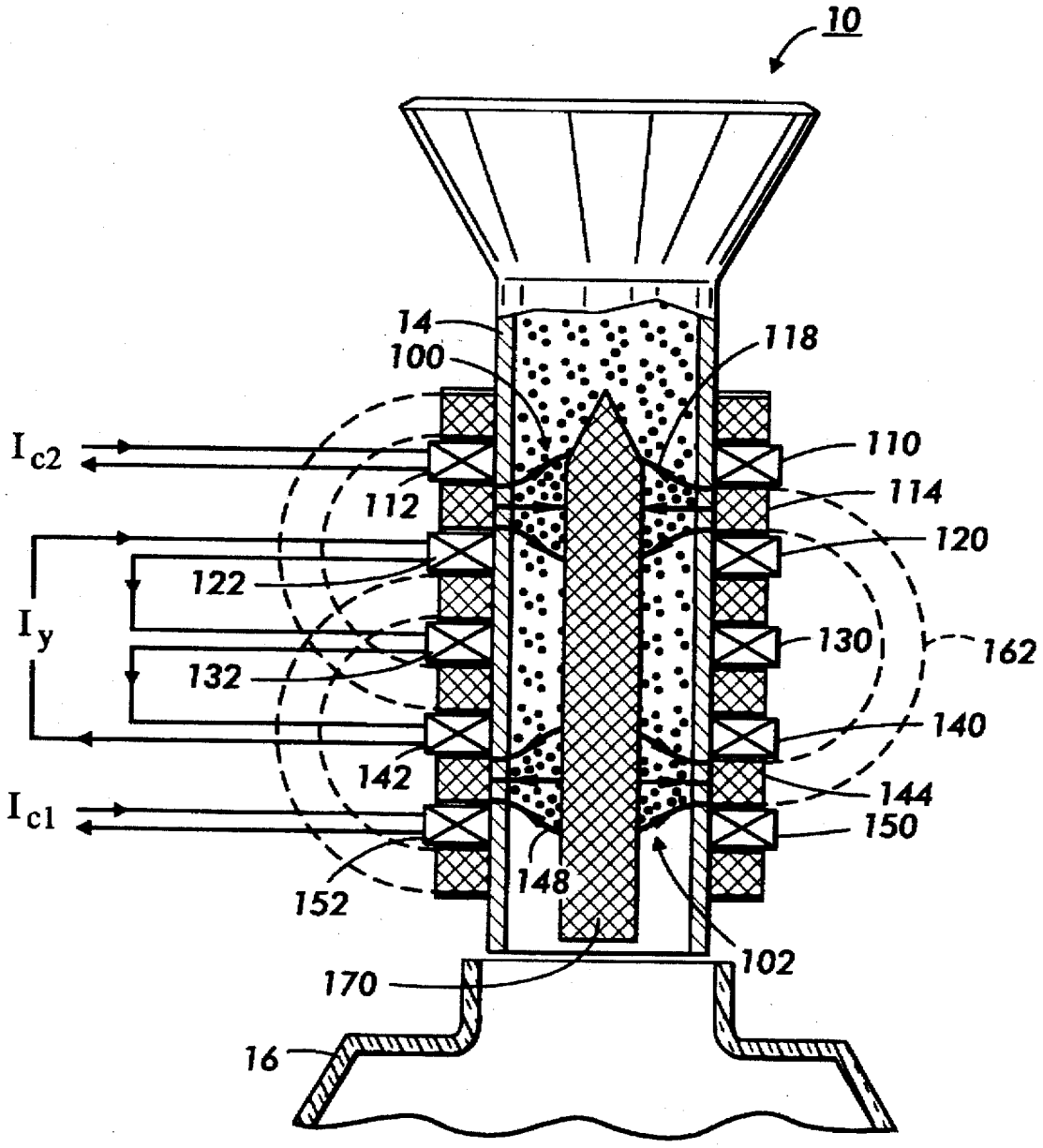

FIG. 7 shows the electromagnetic filler at time $t=t_2$. At this time solenoids 120, 130 and 140 connected by ferrite plate 162 are activated with current ly so that magnetic fields 118 and 148 are formed between ferrite rings 114 and 144. Currents Ic1 and Ic2 flow through non-functioning solenoids 110 and 150 which neutralize the magnetic fields induced in the non-functioning solenoids by the activated solenoids. At this time, the toner plugs 100 and 102 have moved down the fill tube and are held in place by magnetic fields 118 and 148. Toner from the toner supply hopper 10 has moved from the hopper into the fill tube 14 to fill the space on top of the toner plug 100.

Figure 8:
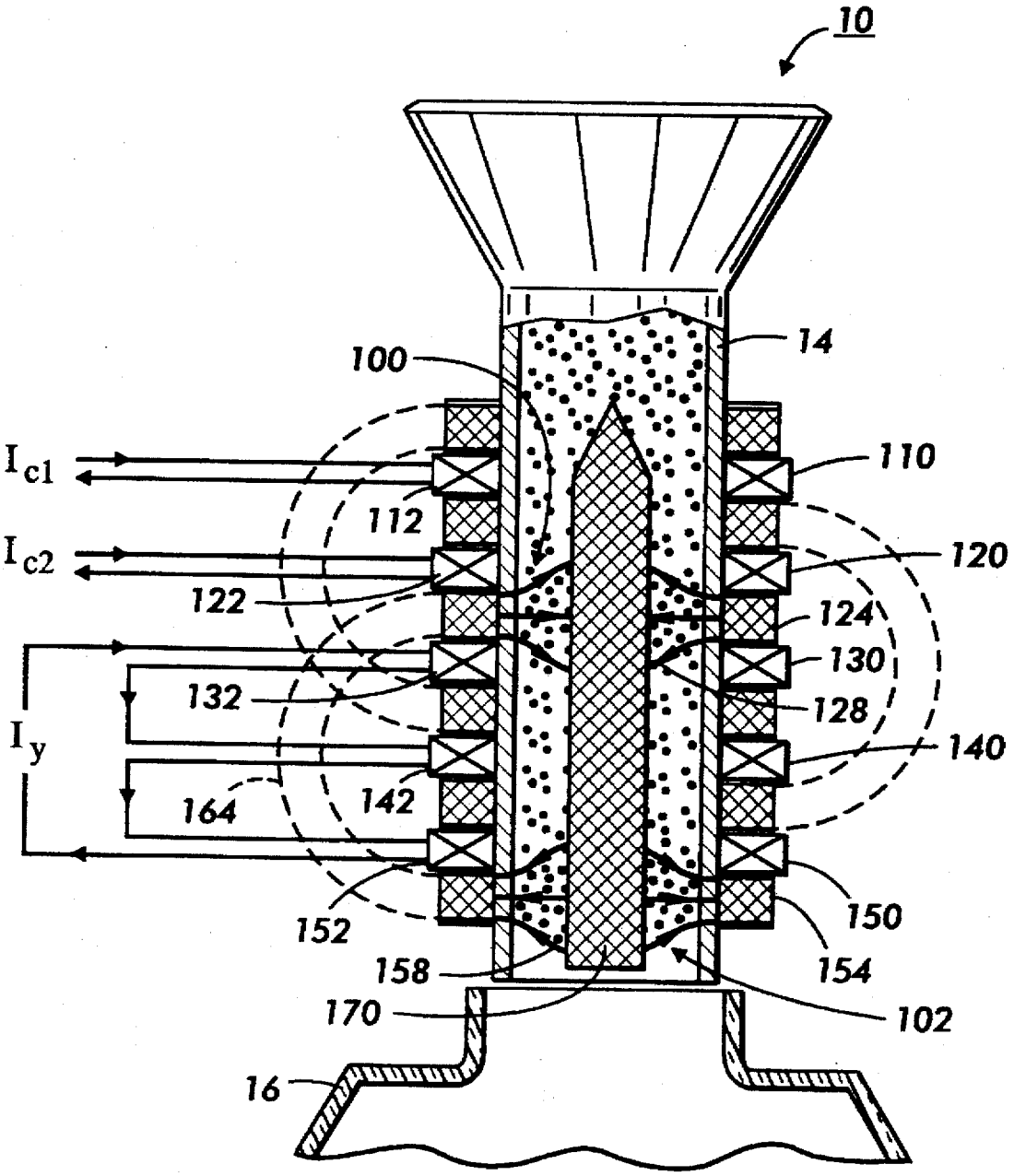

FIG. 8 shows the electromagnetic filler at time $t=t_3$. Solenoids 130, 140 and 150, connected by ferrite plate 164, are activated and have current passing through windings 132, 142 and 152 and magnetic fields 128 and 158 are formed at ferrite rings 124 and 154. Currents Ic1 and Ic2 flow through windings 112 and 122 of solenoids 110 and 120. Again, toner from the supply hopper 10 has entered the fill tube from the movement of the toner plugs 100 and 102 to magnetic fields 128 and 158.

Figure 9:
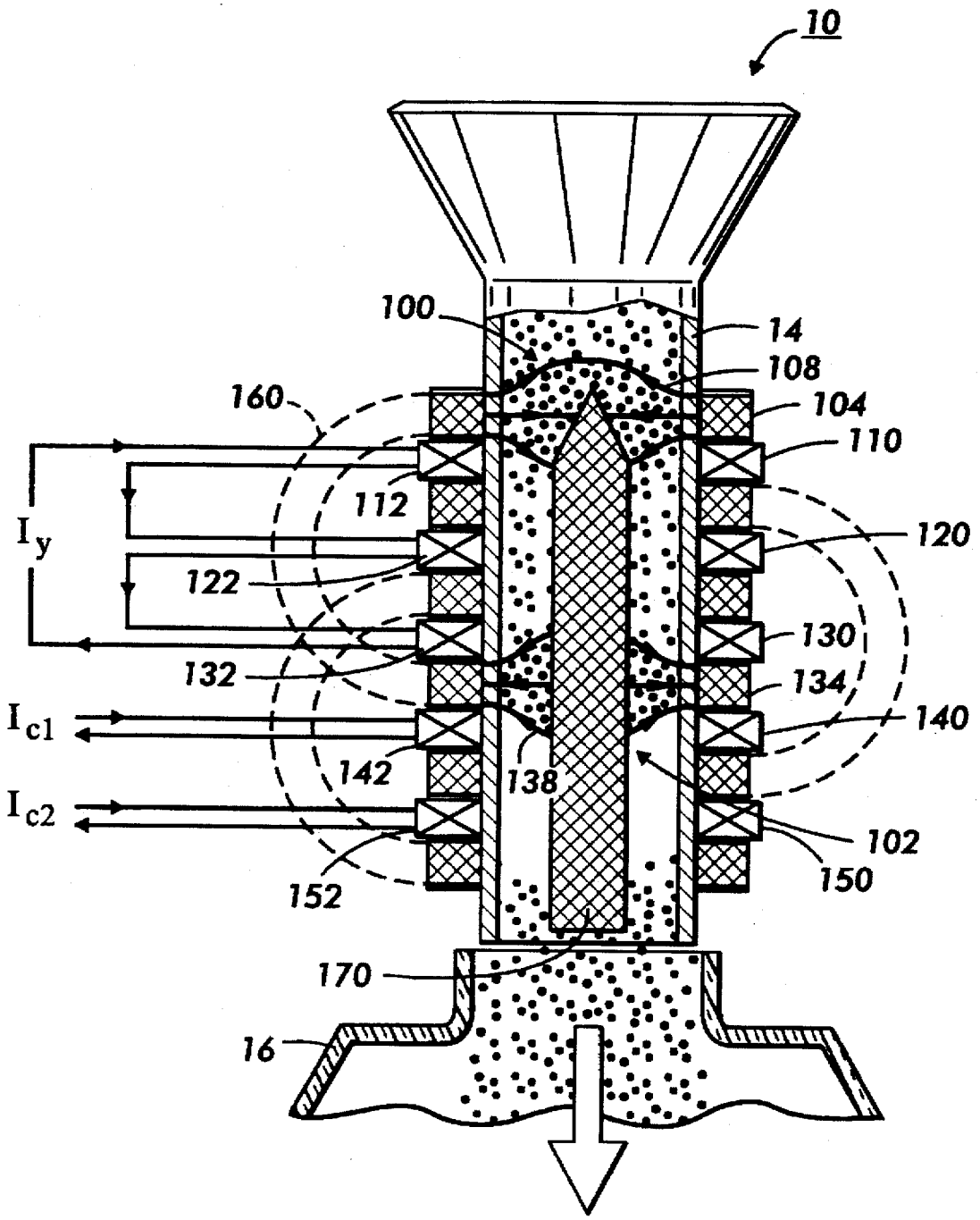

FIG. 9 shows the electromagnetic filler at time $t=t_4$. The activated and non-functioning solenoids are the same as in FIG. 6. Current Iy passing through windings 112, 122 and 132 with magnetic fields 108 and 138 being formed. Currents Ic1 and Ic2 flow through solenoids 140 and 150. Toner plugs 100 and 102 are held by magnetic fields 108 and 138 and plug the flow of toner from the hopper 10 so that the toner container is cleanly filled with the toner between ferrite rings 128 and 158 at $t=t_3$, the toner flowing through a demagnetizing circuit as shown in FIG. 5 prior to entering the container. The cycle is repeated until the toner container is filled with toner. The filled toner container is removed and an empty toner container is put in its place. The toner filling operation is then repeated.

Yet another embodiment of the invention is shown in FIGS. 10–13, this embodiment being drawn to an axial electromagnetic filler. The configuration of the solenoids and ferrite rings are similar to the embodiment shown in FIGS. 6–9, however a non-magnetic core 180 replaces the magnetic core 170 of the radial electromagnetic field embodiment. The non-magnetic core 180 causes the magnetic fields created by the solenoids to be axial fields, the lines of force of the magnetic fields moving through the gap between the ferrite rings restricted to the three solenoids shunted by the external magnetic circuit (160, 162 and 164) and the channel between the non-magnetic core 180 and the fill tube 14. In this configuration a single plug of toner 106 is formed between the shunted solenoids.

Figure 10:
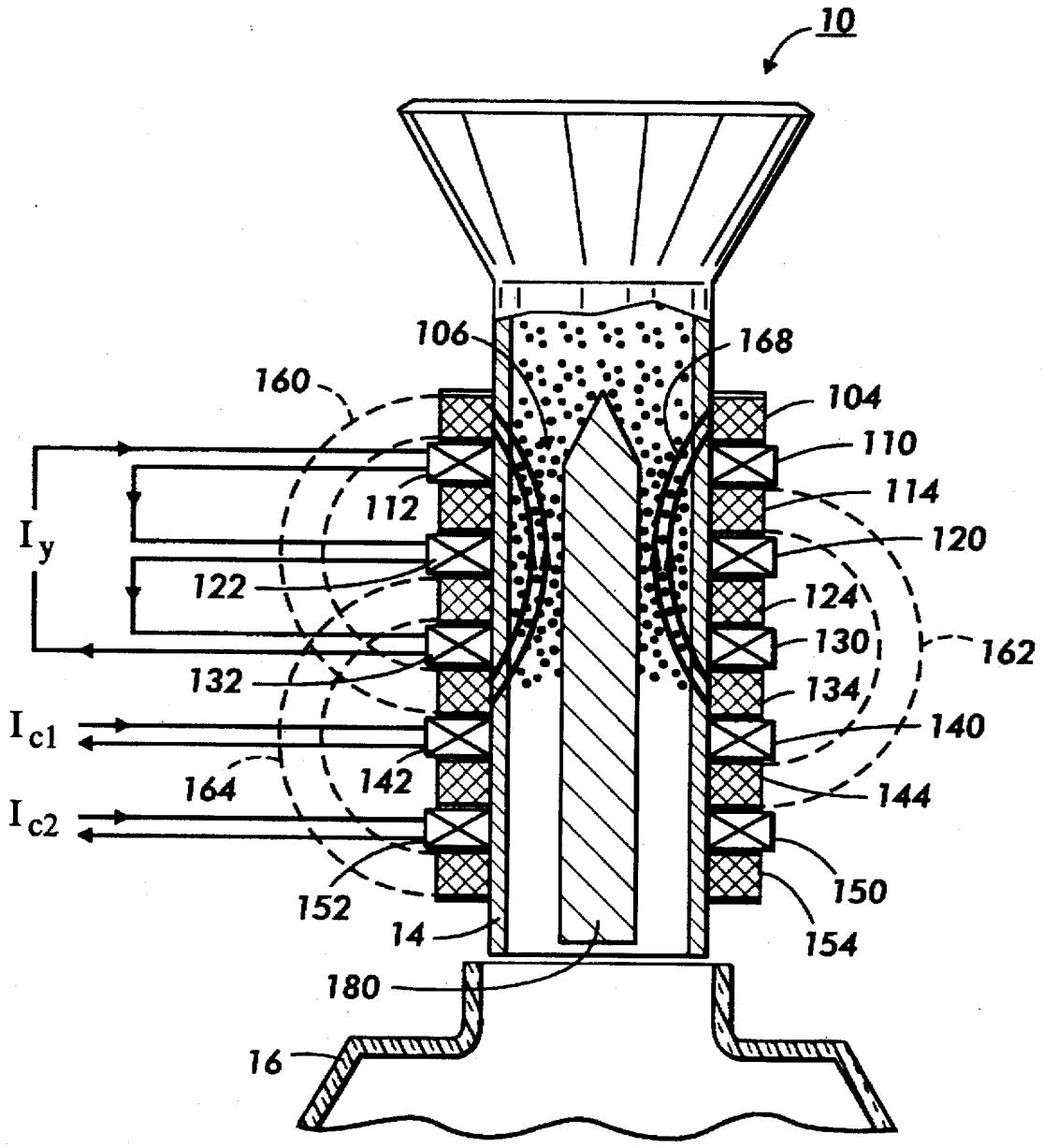
FIG. 10–13 are cross-sectional schematic views of an axial magnetic field toner filling device at times $t_1$–$t_4$.

FIG. 10 shows the electromagnetic filler at time $t=t_1$, with a controlling current Iy produced in windings connected in series 112, 122 and 132. The windings of the other two solenoids 142 and 152, respectively have currents Ic1 and Ic2 passed at this time. Currents Ic1 and Ic2 compensate for the magnetic fields created by current Iy in the non-functioning gaps of the magnetic circuit of the filler. The value of currents Ic1 and Ic2 are determined experimentally by various phases in the work cycle of the filler. At this time toner plug 106 is formed by magnetic field 168, the magnetic field being formed between ferrite rings 104 and 134 which are connected by the ferrite plate 160.

Figure 11:
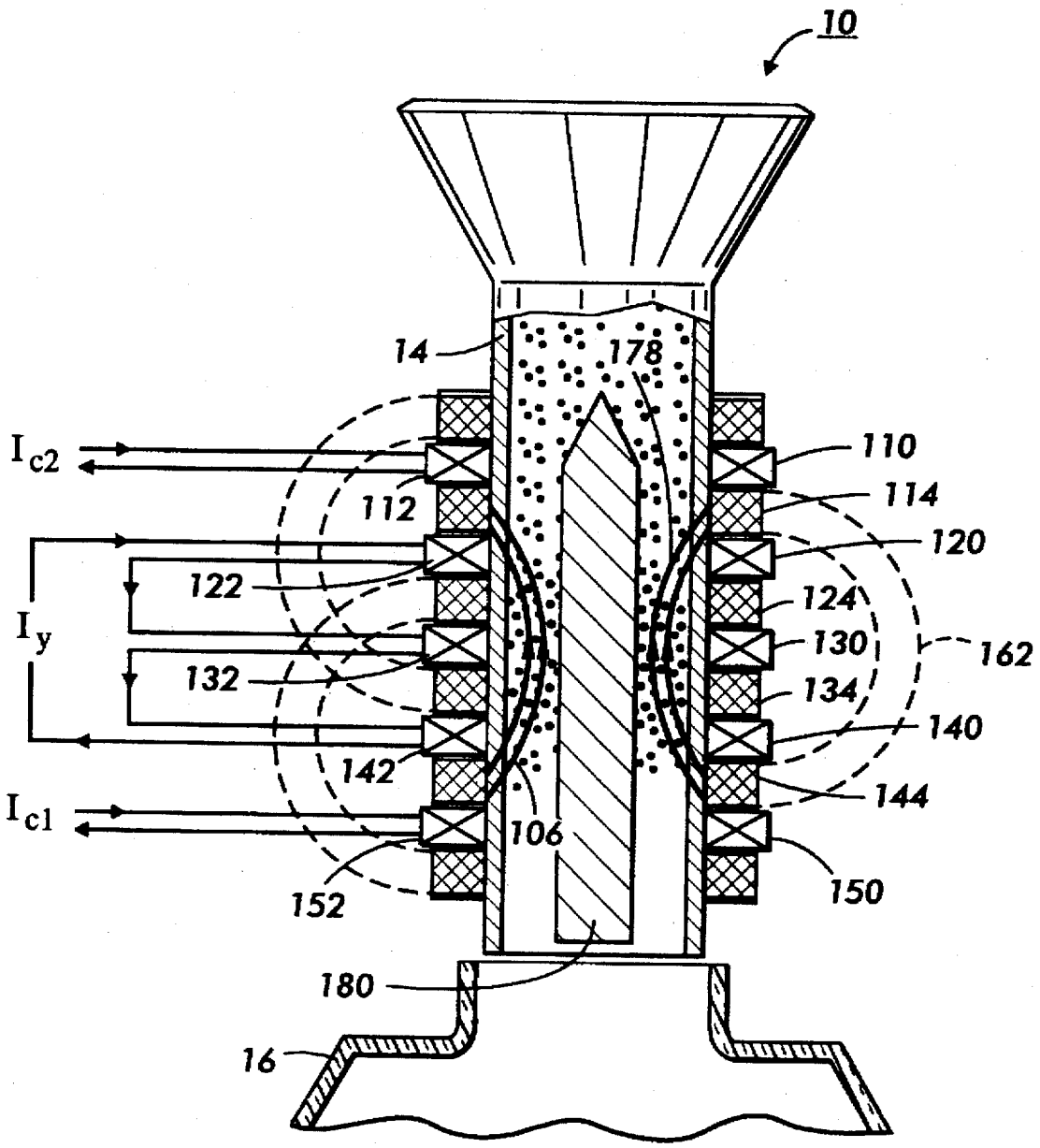

FIG. 11 shows the axial electromagnetic filler at time $t=t_2$. At this time the solenoids 120, 130 and 140 connected by ferrite plate 162 are activated with current Iy so that magnetic field 178 is formed between ferrite rings 114 and 144. Currents Ic1 and Ic2 flow through non-functioning solenoids 110 and 150. At this time, the toner plug 106 has moved down the fill tube and is stopped by magnetic field 178. Toner from the toner supply hopper 10 has moved from the hopper into the fill tube 14 to fill the space on top of the plug 106.

Figure 12:
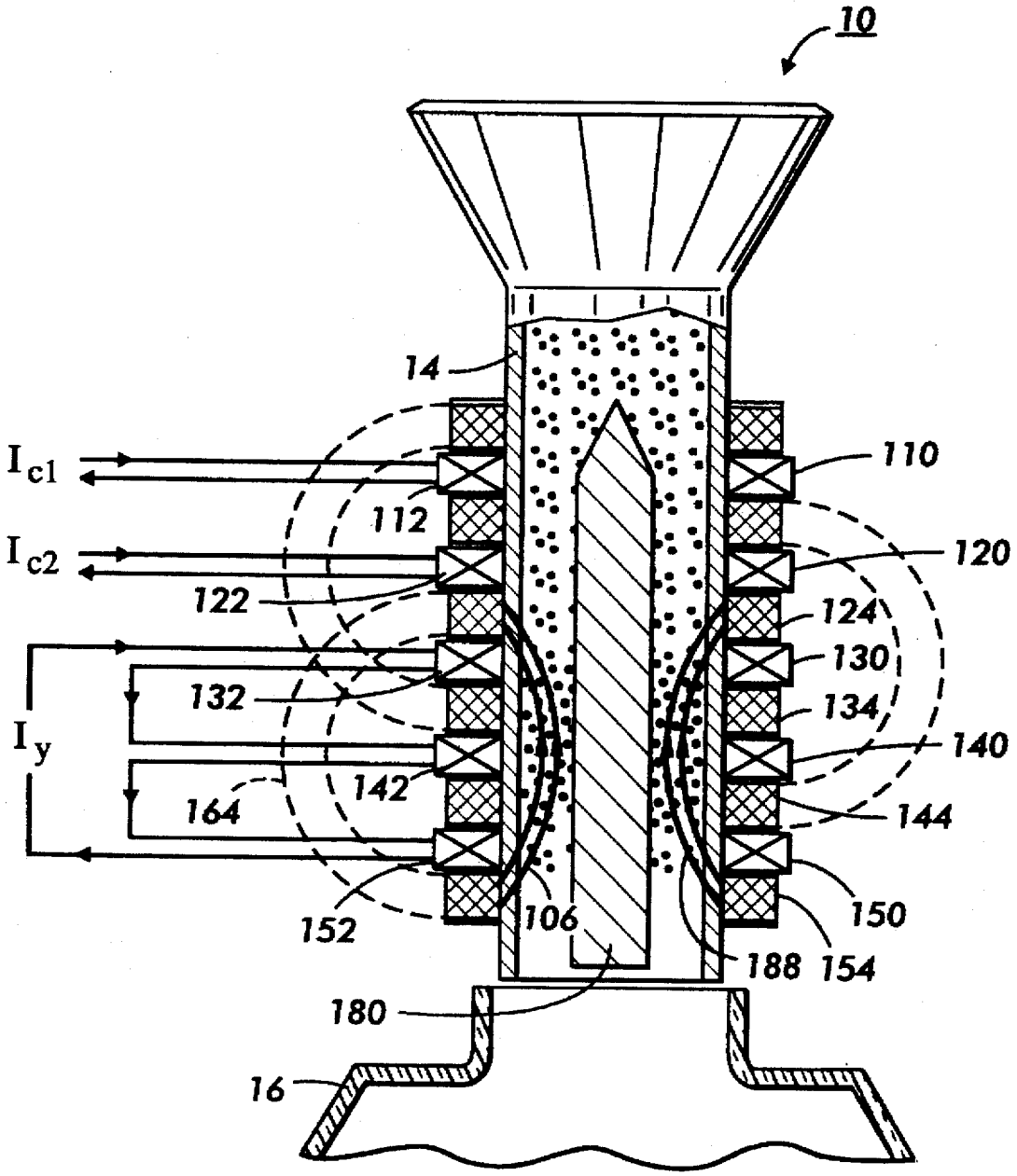

FIG. 12 shows the electromagnetic filler at time $t=t_3$. Solenoids 130, 140 and 150, connected by ferrite plate 164, are activated and have current passing through windings 132, 142 and 152 and magnetic field 188 is formed between ferrite rings 128 and 158. Currents Ic1 and Ic2 flow through windings 112 and 122 of solenoids 110 and 120. Again, toner from the supply hopper 10 has entered the fill tube from the movement of the toner plug 104 to the location of magnetic field 188.

Figure 13:
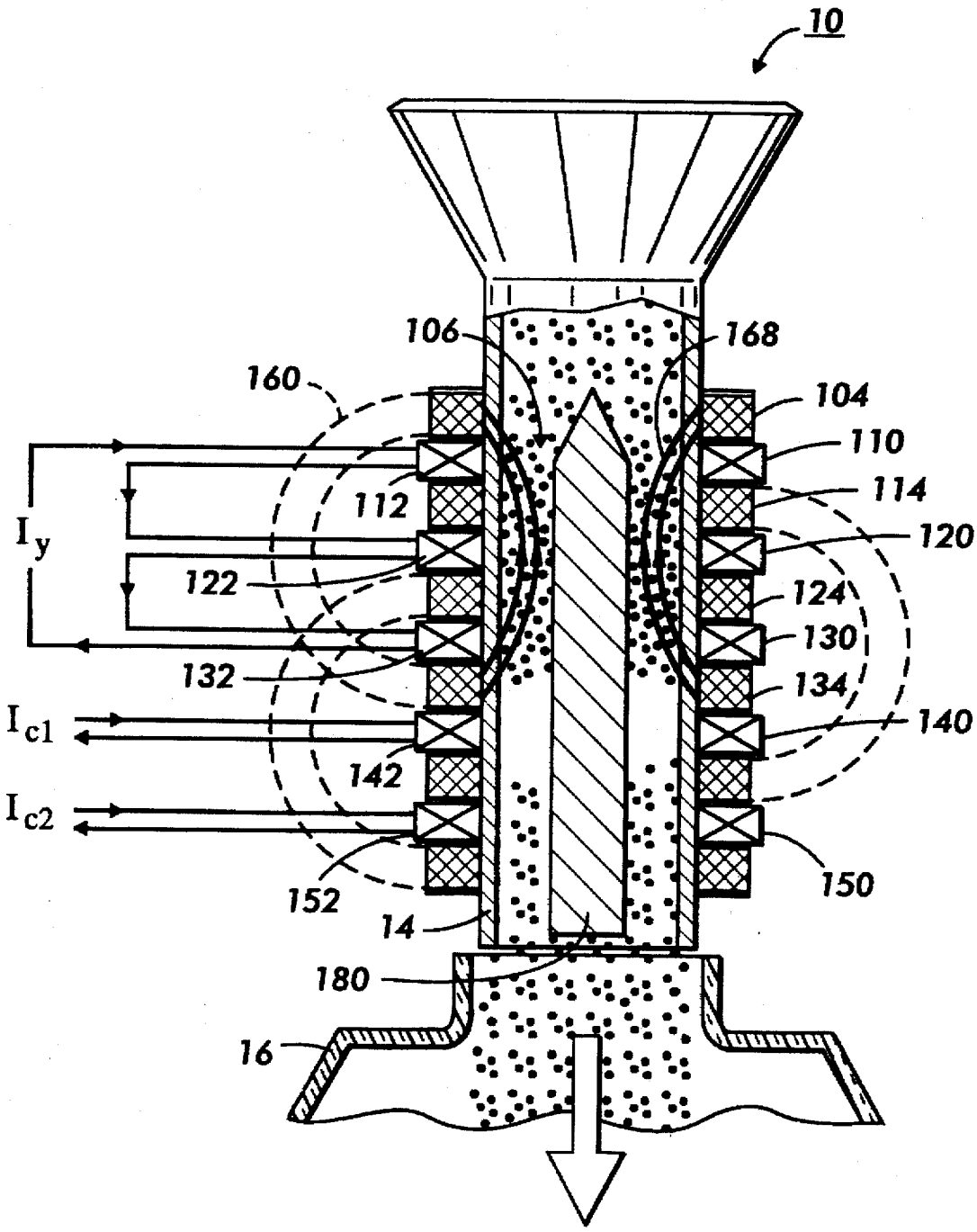

FIG. 13 shows the electromagnetic filler at time $t=t_4$. The activated and non-functioning solenoids are the same as in FIG. 10. Current Iy passing through windings 112, 122 and 132 with magnetic field 168 being formed. Currents Ic1 and Ic2 flow through solenoids 140 and 150. Toner plug 106 is held by magnetic field 168 and plugs the flow of toner from the hopper 10 so that the toner container is cleanly filled with the toner between ferrite rings 128 and 158 at t=t3. The toner flows through a demagnetizing circuit as shown in FIG. 5 associated with solenoid 150 prior to entering the container. Again, the cycle may be repeated as many times as it takes to fill the container 16 with toner, the diameter of the fill tube 14, the magnetic field spacing and the size of the core determining the volume of toner that is moved in each cycle. When the container is filled with toner, the container is removed and an empty toner container is put in its place. The toner filling operation is then repeated.

Figure 14:
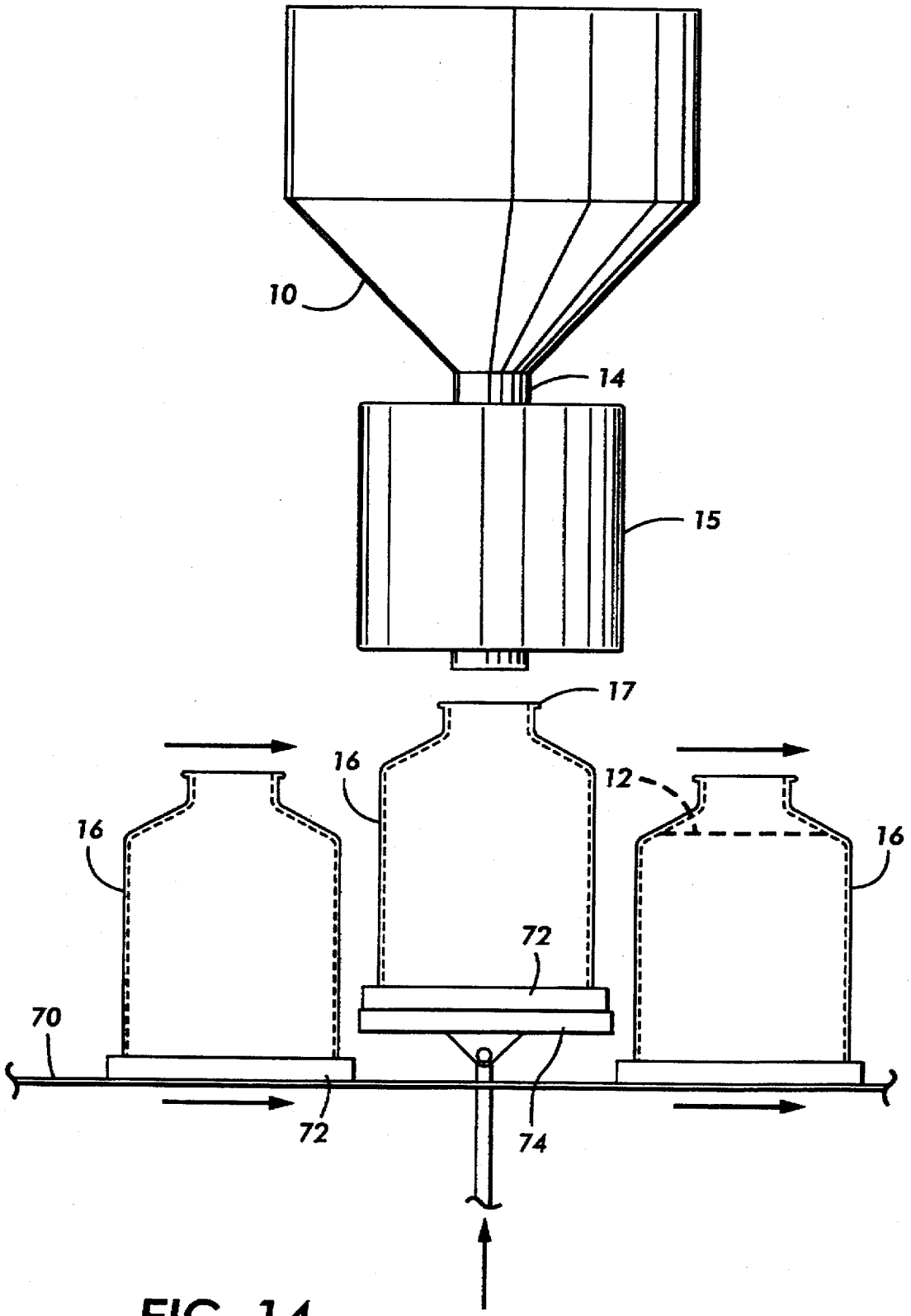
FIG. 14 is a side view of the container filling system prior to filling the container.

FIG. 14 depicts a side view of moving containers 16 along an indexing conveyor 70 relative to the fill tube 14, which is relevant to all of the embodiments. The solenoids of the various embodiments are surrounded by electromagnetic filler cover 15. Each of the containers is positioned in a carrying device 72, also known as a puck. Each puck is specially designed and built for each type of toner container, the puck allowing for different container widths and heights. A puck is used so that the same conveying and lifting system can be used with varying toner container types. When the container is in position under the fill tube the lifting mechanism 74 pushes the puck with the container in it up until the lifting mechanism is fully extended. When the lifting mechanism is fully extended, the container is in the proper filling relationship with the fill tube.

Figure 15:
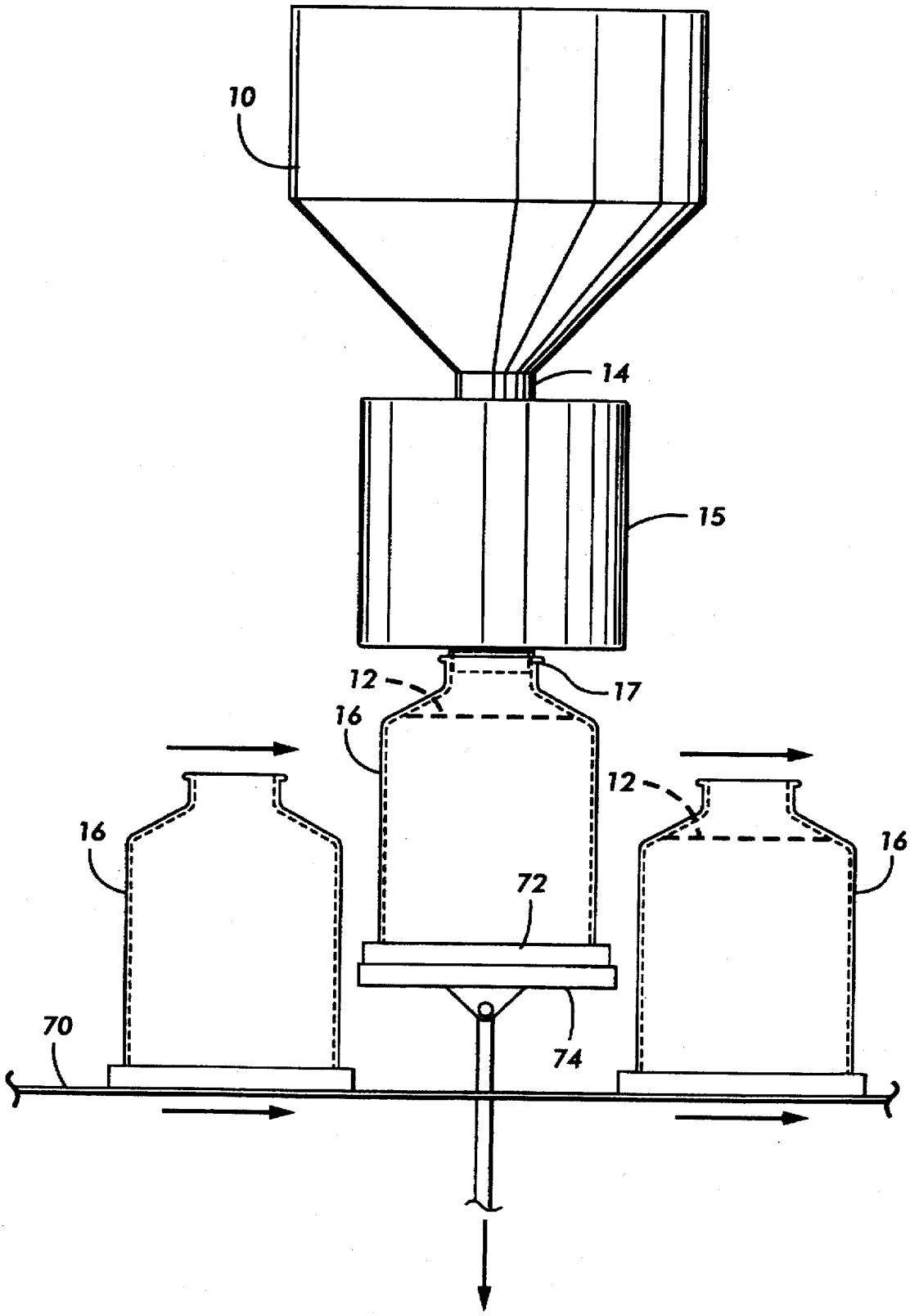
FIG. 15 is a side view of the container filling system after the container is filled.

FIG. 15 shows the container in the proper filling relationship to the fill tube, the container opening 17 receiving the end of the fill tube 14. The amount of toner loaded in the container is predetermined based on the size of the container and the toner flow is controlled by the traveling electromagnetic fields created by the various electromagnetic fillers described above. Once the predetermined amount of toner passes through the fill tube for a particular number of cycles of the electromagnetic filler the container is filled and the filling process is begun again so that as the container is moved from the fill tube, the toner is held in place with a toner plug.

In recapitulation, an electromagnetic filler for developer material has been described as a non-mechanical method for controlling toner flow for filling toner containers. This method allows toner to be moved more accurately and rapidly than mechanical movement systems and also insures that the toner container is filled cleanly.

It is, therefore, apparent that there has been provided in accordance with the present invention, an electromagnetic toner filler that fully satisfies the aims and advantages hereinbefore set forth. While this invention has been described in conjunction with specific embodiments, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method for filling a toner container, comprising:

placing a first toner container to be filled in filling relationship to a fill tube and a supply of toner;

applying a traveling magnetic field to the fill tube so that toner moves from the toner supply through the fill tube and into the first container;

removing the first container from the fill tube;

placing a second container to be filled in filling relationship to the fill tube.

2. A method for filling a toner container as claimed in claim 1, wherein the applying the traveling magnetic field step comprises:

applying a first magnetic field at a first location to attract toner so that toner flows from the toner supply through the fill tube;

removing the first magnetic field and applying a second magnetic field at a second location to attract toner so that toner flows from the toner supply through the fill tube;

removing the second magnetic field and applying a third magnetic field at a third location to attract toner so that toner flows from the toner supply through the fill tube; and repeating the above steps until the first container is filled.

3. A method for filling a toner container as claimed in claim 2, wherein the first, second and third magnetic fields are radial magnetic fields of sufficient strength to stop the flow of toner.

4. A method for filling a toner container as claimed in claim 2, wherein the traveling magnetic field is produced by three solenoids, the first solenoid producing the first magnetic fields, the second solenoid producing the second magnetic field and the third solenoid creating the third magnetic field.

5. A method for filling a toner container as claimed in claim 2, wherein the first, second and third magnetic fields are axial magnetic fields of sufficient strength to stop the flow of toner.

6. A method for filling a toner container as claimed in claim 5, wherein the traveling magnetic field is produced by a series of five solenoids, the first, second and third solenoids being connected to produce the first magnetic field, the second, third and fourth solenoids being connected to produce the second magnetic field and the third, fourth and fifth solenoids being connected to produce the third magnetic field.

7. A method for filling a toner container as claimed in claim 1, wherein the applying the magnetic field step further comprises:

applying a first magnetic field at a first location and a second magnetic field at a second location to attract toner so that toner flows from the toner supply through the fill tube;

removing the first and second magnetic fields and applying a third magnetic field at a third location and applying a fourth magnetic field at a fourth location to attract toner so that toner flows from the toner supply through the fill tube;

removing the third and fourth magnetic fields and applying a fifth magnetic field at a fifth location and a sixth magnetic field at a sixth location to attract toner so that toner flows from the toner supply through the fill tube; and repeating the above steps until the container is filled.

8. A method for filling a toner container as claimed in claim 7, wherein the first, second, third, fourth, fifth and sixth magnetic fields are radial magnetic fields of sufficient strength to stop the flow of toner.

9. A method for filling a toner container as claimed in claim 1, further comprising:

demagnetizing the toner prior to the toner leaving the fill tube.

10. An apparatus for controlling filling of a toner container comprising:

a conveyor for placing a first container in filling relationship with a fill tube and a supply of toner, removing the first container once the first container is filled with toner, and placing a second container in filling relationship with the fill tube and the toner supply;

at least three magnetic field producers used to create a traveling magnetic field which is applied to the fill tube and causes toner to move from the toner supply through the fill tube to fill the first container.

11. An apparatus for controlling filling of a toner container as claimed in claim 10; wherein, the first magnetic field producer produces a first magnetic field applied at a first location to attract toner so that toner flows from the toner supply through the fill tube;

the second magnetic field producer produces a second magnetic field applied at a second location to attract toner when the first magnetic field is removed so that toner flows from the toner supply through the fill tube;

the third magnetic field producer produces a third magnetic field applied at a third location to attract toner when the second magnetic field is removed so that toner flows from the toner supply through the fill tube; and the first magnetic field producer produces a fourth magnetic field applied at the first location to attract toner when the third magnetic field is removed so that toner in the fill tube below the first location flows through the fill tube into the first container.

12. An apparatus for controlling filling a toner container as claimed in claim 11, wherein the fill tube has an open channel so that the magnetic fields produced are radial magnetic fields.

13. An apparatus for controlling filling a toner container as claimed in claim 11, wherein the first magnetic field producer is a first solenoid, the second magnetic field producer is a second solenoid and the third magnetic field producer is a third solenoid.

14. An apparatus for controlling filling a toner container as claimed in claim 11, wherein the first, second and third magnetic field producers comprise:

the first magnetic field producer having a first, second and third solenoid connected to produce the first and fourth magnetic fields, the second magnetic field producer having the second, third and a fourth solenoid connected to produce the second magnetic field and the third magnetic field producer having the third, fourth and a fifth solenoid connected to produce the third magnetic field.

15. An apparatus for controlling filling a toner container as claimed in claim 14, further comprising:

a non-magnetic member located in the fill tube so that the magnetic fields produced by the magnetic field producers are axial magnetic fields.

16. An apparatus for controlling filling a toner container as claimed in claim 10, wherein the first, second and third magnetic field producers comprise:

a first, second and third solenoid connected to produce a first magnetic field applied at a first location and a second magnetic field applied at a second location to attract toner so that toner flows from the toner supply through the fill tube;

the second, third and a fourth solenoid connected to produce a third magnetic field applied at a third location and a fourth magnetic field applied at a fourth location to attract toner when the first and second magnetic fields are removed so that toner flows from the toner supply through the fill tube;

the third, fourth and a fifth solenoid connected to produce a fifth magnetic field applied at a fifth location and a sixth magnetic field applied at a sixth location to attract toner when the third and fourth magnetic fields are removed so that toner flows from the toner supply through the fill tube; and the first, second and third solenoid connected to produce a seventh magnetic field applied at the first location and an eighth magnetic field applied at the second location to attract toner when the fifth and sixth magnetic fields are removed so that toner in the fill tube below the second location flows through the fill tube into the first container.

17. An apparatus for controlling filling a toner container as claimed in claim 16, further comprising:

a magnetic member located in the fill tube channel so that the magnetic fields produced by the magnetic field producers are radial magnetic fields.

18. An apparatus for controlling filling a toner container as claimed in claim 10, further comprising:

means for controlling the magnetic fields such that one of the magnetic fields is activated when the first container is removed and the second container is being placed in filling relationship with the fill tube and the toner supply.

19. An apparatus for controlling filling a toner container as claimed in claim 10, further comprising:

a demagnetizing circuit for demagnetizing toner in the fill tube.

20. An apparatus for controlling filling of a container comprising:

a hopper with a supply of toner;

a first container;

a fill tube through which toner from the hopper passes to the first container;

at least three solenoids located along the fill tube, the three solenoids being controlled to create a traveling magnetic field within the fill tube so that toner is attracted to the magnetic field, causing the toner to move from the hopper through the fill tube;

a demagnetizing circuit for demagnetizing the toner; and a conveyor which moves the first container into filling relationship with the fill tube and removes the first container once it is filled with toner and moves a second container into filling relationship with the fill tube.

* * * * *